US005408244A

United States Patent [19]

Mackenzie

[11] Patent Number: 5,408,244

[45] Date of Patent: Apr. 18, 1995

[54] RADOME WALL DESIGN HAVING BROADBAND AND MM-WAVE CHARACTERISTICS

[75] Inventor: S. Benjamin Mackenzie, Rootstown, Ohio

[73] Assignee: Norton Company, Wrocester, Mass.

[21] Appl. No.: 78,673

[22] Filed: Jun. 16, 1993

Related U.S. Application Data

[63] Continuation-in-part of Ser. No. 817,029, Jan. 3, 1992, abandoned, which is a continuation-in-part of Ser. No. 640,708, Jan. 14, 1991, abandoned.

[51] Int. Cl.[6] ..... H01Q 1/42

[52] U.S. Cl. ..... 343/872; 343/873

[58] Field of Search ..... 343/872, 873; H01Q 1/42

[56] References Cited

U.S. PATENT DOCUMENTS

| | | | |
|---|---|---|---|
| 2,639,248 | 5/1953 | Overholt | 343/872 |
| 3,002,190 | 9/1961 | Oleesky et al. | 343/872 |
| 4,358,772 | 11/1982 | Leggett | 343/872 |
| 4,783,666 | 11/1988 | Ast et al. | 343/872 |
| 4,896,164 | 1/1990 | Burke et al. | 343/872 |
| 5,017,939 | 5/1991 | Wu | 343/872 |

*Primary Examiner*—Donald Hajec
*Assistant Examiner*—Hoanganh Le
*Attorney, Agent, or Firm*—Brian M. Kolkowski

[57] ABSTRACT

The invention describes a multi-layer radome construction which is termed a D-sandwich and allows excellent transmission efficiency over areas of the entire spectrum of DC to at least 100 GHz. The radome wall construction comprises a core layer of low dielectric constant material bounded by intermediate layers of high dielectric constant material which themselves are bounded by additional layers of low dielectric constant material. Each of the low dielectric constant layers has a substantial electrical effect upon the performance of the radome as well as being a high strength material which provides substantial structural rigidity to the radome. The radome may be further provided with one or more protective surface coatings for certain environmental conditions, without destroying the desired transmission characteristics of the radome. The dielectric constant, loss tangent and thickness of the various materials in the multi-layer construction of the invention are designed to provide excellent transmission efficiency over the frequency and angular range desired. The thicknesses of the various layers in the multi-layer construction are also designed to minimize insertion and return losses thereby minimizing loading of radar transmitters as well as being relatively insensitive to aspect angle and arbitrary wave polarization.

26 Claims, 5 Drawing Sheets

RADOME WALL DESIGN HAVING BROADBAND AND MM-WAVE CHARACTERISTICS

CROSS-REFERENCE TO RELATED APPLICATIONS

This application is a continuation-in-part of U.S. Ser. No. 07,817,029, filed Jan. 3, 1992, now abandoned, which is a continuation-in-part of U.S. Ser. No. 07/640,708, filed Jan. 14, 1991, and now abandoned.

FIELD OF THE INVENTION

The invention relates to broadband radomes and the method of construction thereof to allow transmission of electromagnetic signals over an extremely broad bandwidth for microwave communication and radar.

BACKGROUND OF THE INVENTION

Various constructions for radomes have been proposed in the prior art to provide a protective cover for a microwave antenna. A radome must allow transmission of electromagnetic waves therethrough and also provide the proper structural integrity to protect the microwave system. A radome is an electromagnetic window which can be manufactured into a desired shape and is conventionally used in ground based systems as well as on aircraft, missiles, and other flight vehicles carrying radar or other microwave equipment. In the design of a radome, the offsetting goals of structural integrity and electromagnetic transparency compete and depend upon the particular environment in which the radome is to be used.

Conventionally, radome wall structures have included single-layer wall structures of a homogeneous dielectric constant material wherein the thickness of the wall is designed equivalent to an electrical thickness of ½ wavelength or some integer multiple thereof. There have also been thin-wall constructions wherein the thickness of the homogeneous dielectric constant material corresponds to a fraction of the wavelength of electromagnetic energy to be passed through the wall. The thin-wall designs have been found to be suitable for use at very low microwave frequencies where the wavelength of the electromagnetic energy is relatively large. But the resulting walls have had insufficient structural integrity for many microwave applications. A thicker ½ wave wall design which provides adequate strength and rigidity allows transmission of electromagnetic energy within a relatively narrow bandwidth to which the radome is tuned, but electrical performance quickly degrades at frequencies above and below the tuned wall thickness of ½ wavelength or an integer multiple thereof.

In many applications, the radome must allow transmission of electromagnetic energy over a broad bandwidth. The single-layer design using a homogeneous dielectric constant material has resulted in problems in that the material used in their construction are resonant to a given frequency for which it is designed. This causes the transmission and other electrical properties to degrade when the thickness causes an out of resonance condition. The degradation to electromagnetic energy transmission can be reduced by reducing the material thickness of a thin wall radome because the material is reduced to a lower percentage of the wavelength of the energy being passed therethrough, but creates a problem of providing the necessary structural rigidity for desired applications.

There exist various multi-layer radome constructions which offer enhanced bandwidth and structural capabilities. Some of the same considerations with regard to single-layer radome construction must be considered with respect to a multi-layer construction such as the associated resonance phenomena which is dependent upon the thickness of the layers of dielectric constant material. In the multi-layer construction the material thickness can be reduced to thereby reduce the degradation of the transmission capabilities due to the fact that the thickness of the materials are reduced to a lower percentage of the wavelength of the RF energy being passed therethrough. As an example, a conventional "broadband" radome designed to pass frequencies from DC to 18 GHz presents problems in that the radome wall goes in an out of resonance and the wavelength of the upper frequency range is relatively short. Thus, the thicknesses of the layers in a multi-layer construction are normally selected as the minimum thicknesses which meet the structural requirements for a particular application. Presently, radomes can be adequately constructed to meet both the electrical and structural needs in most applications for frequencies between DC and 18 GHz.

In the typical multi-layer construction for a radome, a mix of low dielectric constant and higher dielectric constant materials is utilized. Due to the fact that the low dielectric constant materials do not have the compressive and flexural strength and stiffness which is necessary for most applications, the higher dielectric constant materials with better mechanical properties enable sufficient structural rigidity to be obtained in the construction. In this way, both the structural and electrical needs are met for applications principally in a range from DC to 18 GHz. The multi-layer radome constructions do have advantages over the single-layer construction but also have inherent problems associated therewith. For example, the combination of required dielectric constant values for passing the desired frequency range and still maintaining the required thickness for structural rigidity is somewhat difficult and inefficient with known materials having the desired dielectric constant properties, especially when working with frequencies above 18 GHz.

Some specific examples of multi-layer designs include the A, B and C sandwiches known in the prior art. An A-sandwich comprises two high dielectric constant material layers which are on both sides of a low dielectric constant material core. The A-sandwich enables electromagnetic energy transmission over a specified frequency range but is susceptible to signal degradation at higher frequencies (such as above 18 GHz) or steep incident angles, when there is sufficient material to be structurally adequate.

Another multi-layer configuration is termed the B sandwich which comprises lower dielectric constant materials on both sides of a high dielectric constant core. Although the B-sandwich is superior electrically to the A-sandwich in the higher frequency range and is relatively broadbanded, the B-sandwich generally does not perform well outside this range (both below and above).

Still another configuration is found in the C-sandwich which comprises a core high dielectric constant material bounded by two low dielectric constant layers which themselves are bounded by yet another layer of high dielectric constant material. The C-sandwich construction is generally used where extreme structural rigidity and broadband capabilities are essential. Although better structural rigidity is obtained with a C-sandwich, limitations still exist on the bandwidth characteristics of the construction.

Another multi-layer construction is shown in U.S. Pat. No. 4,613,350 which utilizes an odd number of three or more layers of reinforced PTFE material. The dielectric constant of each layer is designed to be equal to the square root of the product of the dielectric constants of the two bordering layers in this construction. The electromagnetic window designed in this way was found to function over a predetermined transmission frequency range, which as set forth in the examples therein, is in the range of 3 to 12 GHz or similar frequency ranges. Various other radome constructions can be found in U.S. Pat. Nos. 4,725,475, 4,677,443, 4,358,772 and 3,780,374.

U.S. Pat. No. 4,783,666 discloses a protective shield for an electrically steered, high performance C band antenna array in which a sandwich is formed between two fiberglass layers and a central foam core. An additional interior foam layer is provided for structural support and an additional external fumed silica teflon layer is provided for rain protection. The two foam layers have dielectric constants of 1.07 and 1.04 which means that they have no substantial electrical effect upon the system. The outer teflon layer is a paint only 0.009" thick and thus it has little physical strength and adds no substantial structural rigidity to the final shield.

Although these examples of radome constructions have been found to be suitable over designated frequency ranges of DC to 20 GHz or a relatively narrow bandwidth of higher frequencies, many applications which are presently being developed require much higher frequencies and also much greater broadband characteristics. For example, in many applications the transmission characteristics of the radome are desired to include frequencies of up to 100 GHz or above. It should be recognized that at extremely high frequencies in the range of 100 GHz, the wavelength of the electromagnetic energy is extremely small and the offsetting electrical and structural needs are in sharp contrast.

Based upon the foregoing, it is a main object of the present invention to provide a radome or electromagnetic window construction which may be suitably formed to any shape or size to enable adequate protection of an antenna which is radiating or receiving electromagnetic energy in the range from DC to 100 GHz or above.

It is another object of the invention to provide a radome construction which preserves the transmission characteristics over a large bandwidth, such as DC to 100 GHz, with minimum aberration or distortion and maximum efficiency.

It is a further object to provide an extremely broadband radome construction which is not extremely sensitive to incident angle deviations or polarization effects.

It is yet another object of the invention to provide a novel radome construction which has extremely broadband transmission characteristics compared to prior art and continues to be resistant to thermal stresses as well as erosion due to impact of rain, dust or other particles. Thus, the radome construction is usable either as a ground-based system or under aerodynamic loads in use with flight vehicles or the like.

Another object is to provide good performance over a wide angular range of incident electromagnetic energy.

SUMMARY OF THE INVENTION

These and other objects of the invention are accomplished by a multi-layer radome construction which may be termed a "D-sandwich" and allows excellent transmission efficiency over the entire spectrum of DC to at least 100 GHz. The radome wall construction comprises a core layer of a low dielectric constant material bounded by intermediate layers of high dielectric constant material which themselves are bounded by additional layers of low dielectric constant material. The terms "low" and "high" are used herein in a relative sense with specific values of the dielectric constants being within the skill of a radome designer to determine, based upon the specific intended use and conditions of use of the radome being designed. Each of the layers, including the low dielectric constant layers, will have a substantial electrical effect upon the performance of the radome, i.e. removal of any layer will substantially change the electrical performance of the radome. In a preferred form, the multi-layer radome wall may utilize material having a low dielectric constant such as DuPont's Teflon® polytetrafluoroethylene polymers or Allied-Signal, Inc.'s Spectra® highly oriented polyethylene polymers in a resin matrix, and the high dielectric constant material layers may be formed from a resin matrix such as polyester or epoxy having glass fibers incorporated therein for reinforcement of these layers. The radome may be further provided with one or more conventional surface protective coatings which are very thin layers of materials which provide enhanced erosion protection for such as rain or other precipitation as well as ultraviolet light protection. The coatings provide desired resistance for use under certain environmental conditions without destroying the desired transmission characteristics of the radome and without exhibiting any substantial electrical effect on the performance of the radome.

The dielectric constants, loss tangents, and thicknesses of the various materials to be used in the multilayer constructions of the invention are designed to provide excellent transmission efficiency over the frequency range desired. The thicknesses of the various layers in the construction can be designed to minimize insertion and return losses, thereby minimizing loading of radar transmitters as well as causing the radome to be relatively insensitive to aspect angle and arbitrary wave polarization. The method of construction allows the transmission performance to be obtained with reasonable production methods and enables the resulting layered constructions to be formed into any desired shape. It is intended that this approach shall be known as a D-Sandwich. It produces an optimized performance design for selective application needs.

BRIEF DESCRIPTION OF THE DRAWINGS

These and other features, objects and advantages of the invention will be apparent from the following detailed description taken in conjunction with the drawings wherein.

DETAILED DESCRIPTION OF THE PREFERRED EMBODIMENTS

Figure 1:
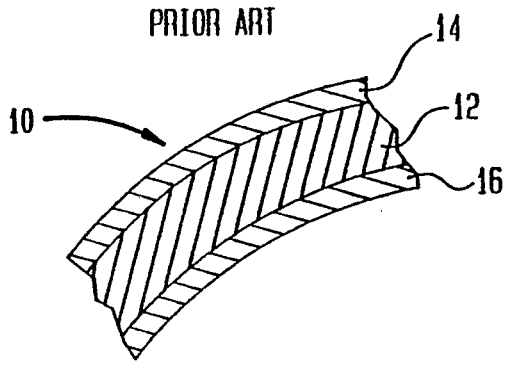
FIG. 1 PRIOR ART
FIG. 1 shows a prior art A-sandwich construction.
Figure 2:
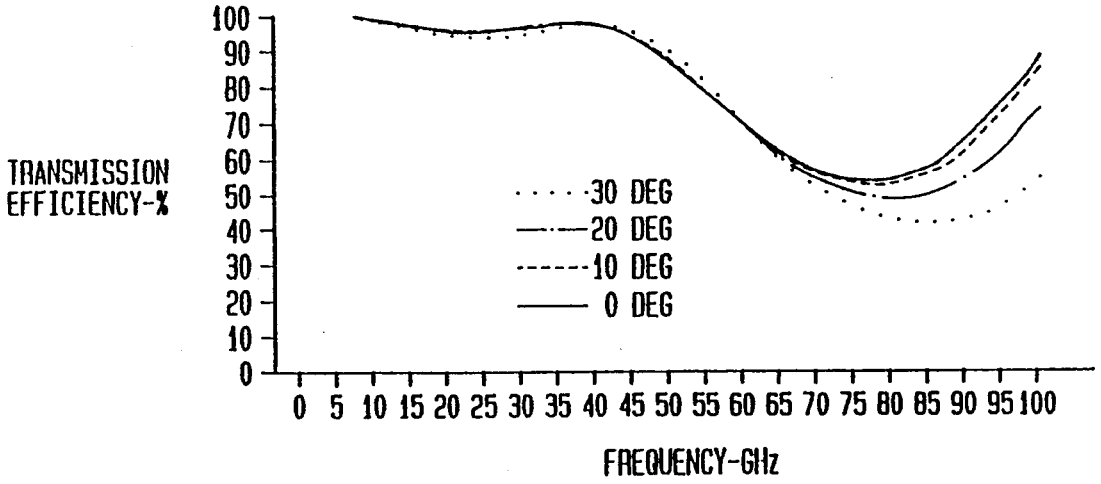
FIG. 2 is a computer modeled plot of the transmission efficiency verses frequency of the A-sandwich construction as shown in FIG. 1 at various aspect angles which has been attempted to be tuned over the range from DC to 100 GHz.

Referring now to the drawings, FIG. 1 shows a multi-layer radome construction 10 commonly referred to as A-sandwich which comprises a core layer 12 of material having a low dielectric constant. The low dielectric constant material 12 is sandwiched between skins of high dielectric constant material 14 and 16 which provide a greater strength-to-weight ratio along with giving more broadband capability than a solid wall radome. The optimum spacing between skin layers 14 and 16 of high dielectric constant material or the thickness of a core 12 is approximately $\frac{1}{4}$ wavelength of the desired frequency to be passed. As seen in FIG. 2, a computer modeled plot of the transmission efficiency percentage verses frequency is shown for the A-sandwich construction of FIG. 1 for frequencies between DC (zero) and 100 GHz. The A-sandwich configuration to operate these plots was attempted to be designed to operate over this frequency range. It is noted that the A-sandwich 10 has relatively good transmission efficiency over a frequency spectrum from 0–40 GHz after which the transmission efficiency dropped to only about 50% in the 80 GHz region. Also, as the aspect angle of incident microwave energy increased from normal, the transmission efficiency further degraded.

A problem arises for radomes which must operate above 20 GHz and also be broadbanded. As the wavelength becomes short relative to the layers of the radome, which must meet minimum structural requirements, the electrical performance of a radome degrades significantly due to reflections and absorption within the radome layers. Thus, for applications requiring the radome to operate above 20 GHz and up to approximately 100 GHz with acceptable transmission efficiency, the A-sandwich 10 has been found to be unsatisfactory. The example shown is also quite fragile and is not structurally satisfactory for most applications.

Figure 3:
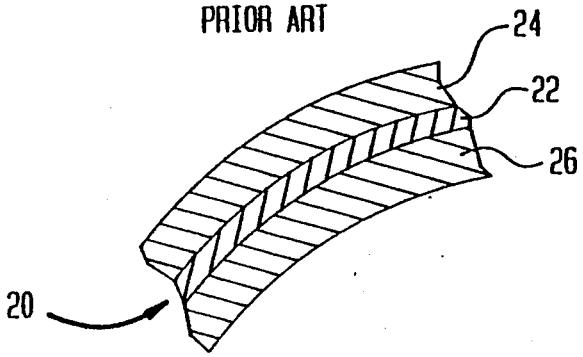
FIG. 3 PRIOR ART
FIG. 3 is a prior art B-sandwich construction.

In FIG. 3, another prior art multi-layer radome construction 20 is shown which is commonly referred to as a B-sandwich having a core layer 22 of a high dielectric constant material such as polyester/glass or an epoxy/-glass laminate which is bounded on either side by low dielectric constant layers 24 and 26 of Teflon® polymers or the like. In reference to FIG. 4, the B-sandwich transmission efficiency is shown. The B-sandwich multi-layer construction produces a radome which works quite well over a broad range of short wavelength frequencies over which the B-sandwich is tuned. By selecting the thicknesses of the multi-layer construction suitably, the B- sandwich can be tuned for 20 to 40 GHz with acceptable transmission efficiency as an example.

Figure 4:
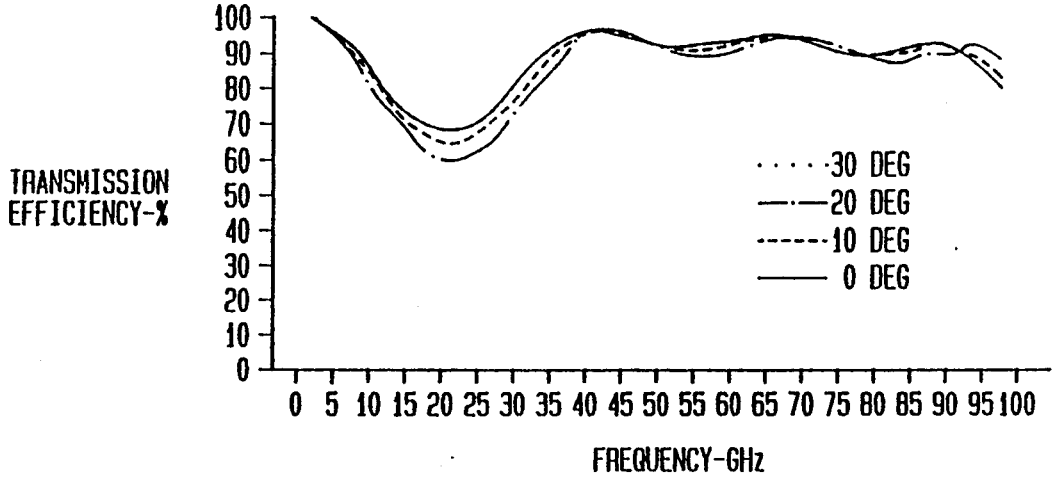
FIG. 4 is a computer modeled plot of the transmission efficiency verses frequency for the B-sandwich which as shown in FIG. 3 at various aspect angles which has been attempted to be tuned over the range from DC to 100 GHz.

However, unlike the A-sandwich as shown in FIGS. 1 and 2, the B-sandwich does not provide acceptable transmission efficiency over a very broad range of frequencies. As shown in FIG. 4, a B-sandwich construction was computer modeled by adjusting the layer thicknesses in an attempt to provide acceptable transmission efficiency over a frequency range from 20 to 100 GHz. An acceptable transmission efficiency usually requires a 70% minimum transmission efficiency, preferably at least 80%, and most preferably at least 85% transmission efficiency average over the frequency range. Although the B-sandwich did produce relatively good broadband characteristics as compared to the A-sandwich of FIGS. 1 and 2 the transmission efficiency was well below the 70% minimum requirement over the 15 to 25 GHz range and the aspect angle of incident energy significantly effected the transmission characteristics.

Figure 5:
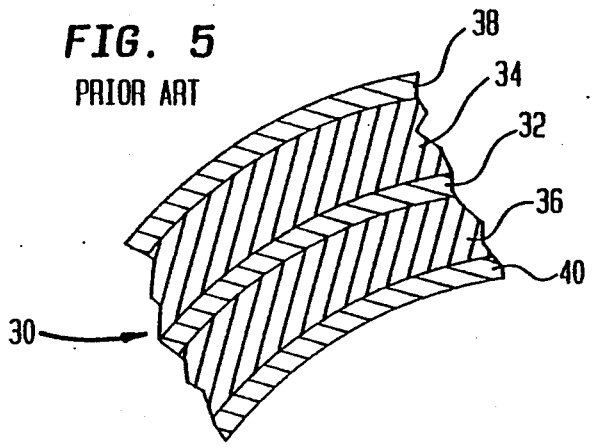
FIG. 5 PRIOR ART
FIG. 5 is a prior art 5-layer C-sandwich construction.
Figure 6:
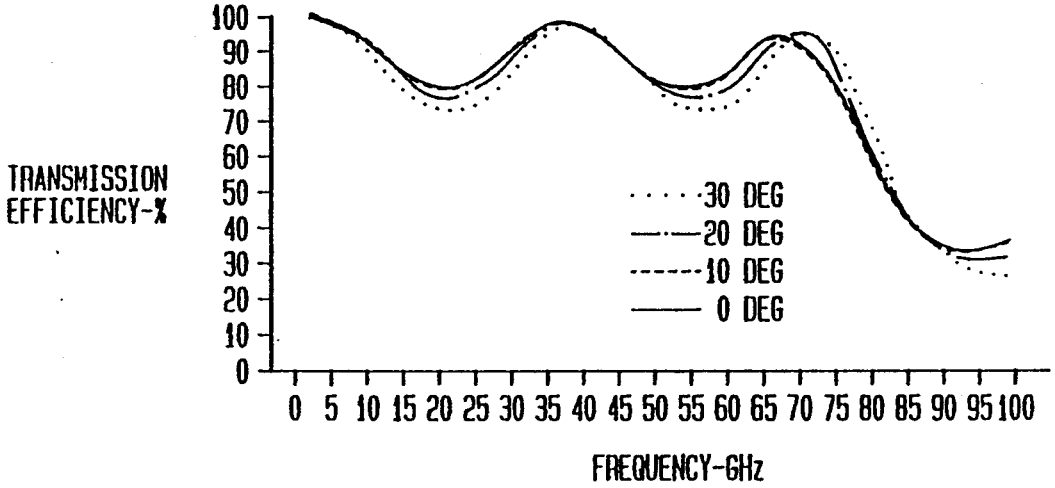
FIG. 6 is a computer modeled plot of the transmission efficiency verses frequency for the C-sandwich as shown in FIG. 5 at various aspect angles which has been attempted to be tuned over the range from DC to 100 GHz.

Still another prior art multi-layer construction 30 is shown in FIG. 5 which is commonly referred to as the C-sandwich. The C-sandwich radome construction comprises a core layer 32 of high dielectric constant material which is bounded on either side by layers 34 and 36 of a low dielectric constant material which themselves are bounded by additional layers 38 and 40 of high dielectric constant material. The C-sandwich radome construction provides excellent structural rigidity and may provide satisfactory transmission efficiency over a somewhat broad band frequency range, but as seen in FIG. 6, the transmission efficiency varies greatly over the frequency spectrum from 0 to 100 GHz with very unsatisfactory transmission characteristics at higher frequency ranges and various aspect angles.

Figure 7:
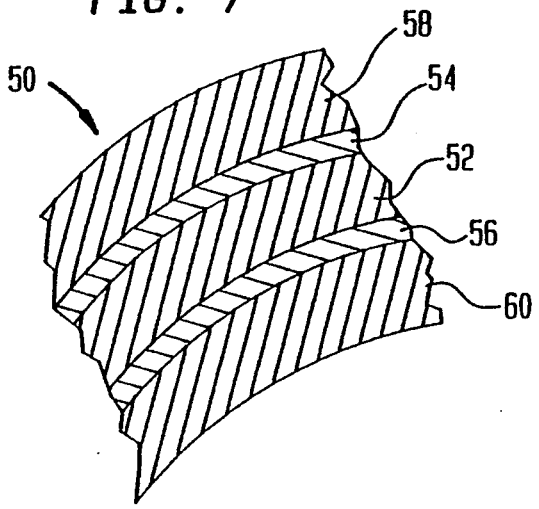
FIG. 7 shows the multi-layer construction of the present invention designed to be used over a frequency range of D.C. to 100 GHz.

There has therefore been found a need to provide a radome construction which yields acceptable transmission efficiency over the broad frequency bandwidth from D.C. to 100 GHz and also provides sufficient structural rigidity to be used in desired environmental conditions. The present invention provides a multi-layer radome construction 50 as shown in FIG. 7 which comprises a core layer 52 of a relatively low dielectric constant material bounded on either side by layers 54 and 56 of a relatively high dielectric constant material. The layers 54 and 56 of relatively high dielectric constant material are themselves bounded by additional layers 58 and 60 of a relatively low dielectric constant material. If desired the sequence of relative dielectric constants, i.e. LOW-HIGH-LOW-HIGH-LOW, may be extended to seven layers, i.e. LOW-HIGH-LOW-HIGH-LOW-HIGH-LOW, or even nine layers, i.e. LOW-HIGH-LOW-HIGHLOW-HIGH-LOW-HIGH-LOW, or more, although no benefit has yet been noted from so doing.

In a preferred embodiment, the low dielectric constant material used in the multi-layer construction of the invention is a polyethylene fiber which has been oriented and is in a resin matrix such as the Spectra® fibers produced by and commercially available from Allied-Signal, Inc., which has been found to give substantial structural rigidity to the multilayer sandwich constructions along with providing the desired low dielectric constant characteristics. U.S. Pat. Nos. 4,413,110 and 4,536,536 disclose the preparation of such oriented polyethylene fibers and are incorporated herein by reference. While the Spectra® polyethylene fiber has been found to provide desirable characteristics for a radome construction, other known high strength, low dielectric constant, light weight materials such as Teflon® polytetrafluoroethylene polymer, Kevlar® polyamide polymer, and the like, may be utilized and such is contemplated herein. The low dielectric constant materials in addition to having a high strength will generally each provide substantial structural rigidity to the radome. The low dielectric constant material will generally have as low a dielectric constant as possible while still having a substantial electrical effect upon the performance of the radome. Since the dielectric constant of air is 1, materials having a dielectric constant below about 1.5 will have no substantial electrical effect on the radomes. Preferably the dielectric constant of the low material is below about 3.5, more preferably below about 3, and still more preferably about 2 to 2.5. So long as the material has a substantial electrical effect, the specific value is only important in determining the frequencies to which the radome can be tuned.

The higher dielectric constant material layers 54 and 56 are preferably a laminate formed of a glass fiber in a polyester or other resin matrix. The fiberglass fibers are utilized as reinforcing fibers and may be formed of other inorganic materials such as ceramics or the like. A suitable material for the low dielectric constant layers is a mixture known as RT/Duroid made by Rogers Corporation, Rogers, Conn. and disclosed in U.S. Pat. No. 4,613,540. It should be understood that the specific materials which can be utilized for the higher dielectric constant material is secondary to the present invention and that it is the relative dielectric constants of the layers which is the present invention. As such suitable materials for the high dielectric constant layer include all materials suitable for use in other radome constructions. These materials are well known in the art and thus are not further detailed herein. Preferred dielectric constants for the high dielectric constant material are those which are greater than the dielectric constant used for the low dielectric constant material. More preferred materials for use as the high dielectric constant materials are those which have dielectric constants generally in the range of about 3.5 to 8, still more preferred about 4 to 6, and still more preferred about 4 to 5.

With both the lower dielectric constant and higher dielectric constant materials used in the multi-layer construction of the invention, it is only necessary that the proper dielectric constant is achieved having the desired thickness to give the multi-layer construction the desired structural rigidity and electrical properties.

In a preferred example of the multi-layer construction 50 as shown in FIG. 7, the core layer 52 as well as the outside layers 58 and 60 of low dielectric constant material may have a thickness between about 0.01 and 0.1 inches which is chosen as a percentage of the wavelength desired to be passed by the radome construction. The dielectric constant of the layers 52, 58 and 60 of "low" dielectric constant material are most preferably chosen to be approximately half that of the "high" dielectric constant material layers and may for example have a dielectric constant in the range between about 2.0 and 2.5. It is also preferred that the low dielectric constant materials also have a low loss tangent between about 0.0001 and 0.01.

The layers of high dielectric constant material 54 and 56 may range from about 0.005 to 0.02 inches in thickness, which in conjunction with the thicknesses of the low dielectric constant material provide optimal transmission efficiency along with structural integrity to the multi-layer construction. The dielectric constant of the high dielectric constant material may range from about 4.0 to 5.0 and have a loss tangent between about 0.01 and 0.02. The layers of low or high dielectric constant material may be identical in the multi-layer construction or be varied with respect to one another to provide various advantages as desired by the radome designer.

Figure 8:
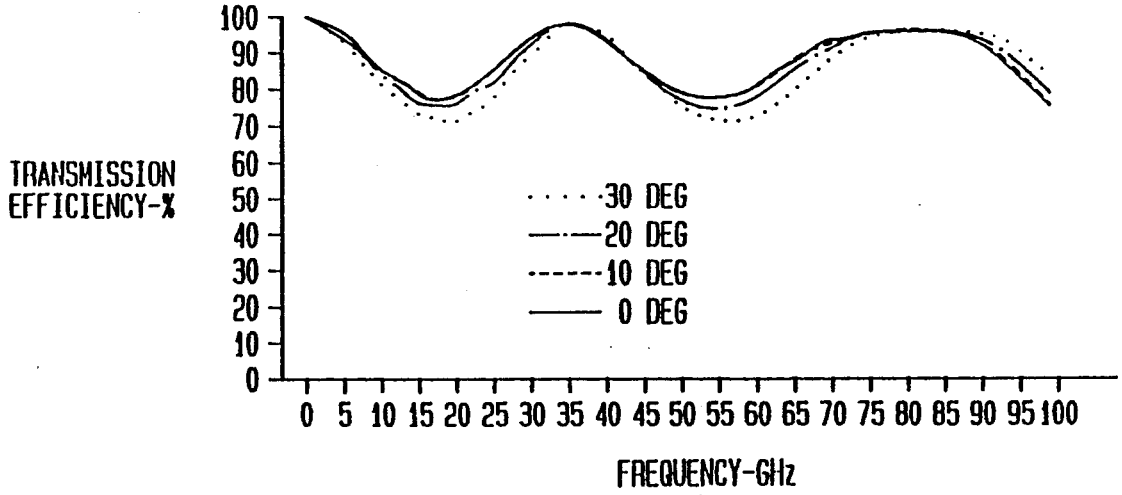
FIG. 8 shows a computer modeled plot of the transmission efficiency verses frequency for the multi-layer construction as shown in FIG. 7 at various aspect angles.

An example of the performance characteristics of the multi-layer construction of the invention is shown in FIG. 8, in which the transmission efficiency of the multi-layer construction 50 of the invention is computer modeled over the frequency range from 0 to 100 GHz. The plots as shown in FIG. 8 are based upon a flat panel of the multi-layer construction wherein the low dielectric constant material layers were identical and each was about 0.03 inches thick and had a dielectric constant of 2.45 and a loss tangent of 0.0008. The high dielectric constant material layers were also identical and each had a thickness of about 0.01 inches with a dielectric constant of 4.15 and a loss tangent of 0.015. It is noted that the plots for all aspect angles show excellent transmission characteristics for the multi-layer construction of the invention over the entire frequency range from 0 to 100 GHz. It is noted that the mean transmission efficiency over this entire frequency spectrum is approximately 87% and nowhere did the transmission efficiency fall below the 70% level. It is also noted that at the atmospheric windows for microwave transmission frequencies which occur at approximately 35 and 94 GHz both have excellent transmission efficiency. It is also seen that at lower frequencies of 0 to 20 GHz the transmission efficiency is maintained well above the 70% acceptable level and has a mean value of approximately 90%. Thus, at relatively low frequencies of 0 to 20 GHz, the multi-layer construction has excellent transmission characteristics and at very high frequencies of 80 to 100 GHz, the transmission efficiency is excellent. Under many applications, both the relatively low frequency and very high frequency ranges are important thereby necessitating a radome construction which has excellent transmission efficiency over these ranges. Before the radome construction of the present invention, the ability to obtain acceptable transmission efficiency over this spectrum has been virtually unachievable. The radome construction is also less sensitive to aspect angle variations. It is especially preferred to produce radomes by the present invention which radomes are tuned to specific frequencies: 35, 85 and 94 GHz.

Figure 9:
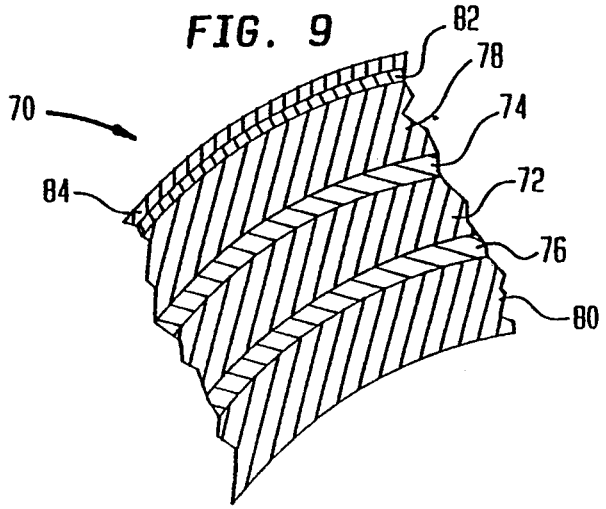
FIG. 9 shows a multi-layer radome construction in accordance with the invention including an outer coating layer of material having high strength and durability.

Turning now to FIG. 9, there is shown another alternate embodiment of the multi-layer radome construction of the invention. Due to the fact that a low dielectric constant material layer is formed on the outer periphery of the radome construction as seen in FIG. 7, the radome construction may not have the compressive and flexural strength on its outer surface which is normally desired under certain environmental conditions, such as flight conditions. Although the multi-layer construction of the present invention has overall stiffness and rigidity which is sufficient for most applications including those on flight vehicles, the outer layer of low dielectric constant material may not have sufficient resistance to erosion, ultraviolet light, and thermal stress which are important for a radome to function for an extended period under high-speed applications such as on flight vehicles. In the embodiment as shown in FIG. 9, the multi-layer construction 70 comprises a core layer 72 of low dielectric constant material bounded by high dielectric constant layers 74 and 76 which themselves are bounded by low dielectric constant material layers 78 and 80 similar to that shown in FIG. 7. The outer layer 78 of low dielectric constant material which will be exposed to the environmental conditions, e.g. rain erosion and ultraviolet light degradation, may be provided with a protective surface coating of a thin layer of an epoxy/fiberglass composition similar to that used for the high dielectric constant layers 74 and 76. The actual maximum thickness of such a protective coating should be about 50% or less than the thickness of the thinnest layer of the radome. Atop this thin layer 82 of epoxy/fiberglass, there may also be provided a paint layer 84 which can act to seal the construction and provide ultraviolet light resistance. The use of one or both such coatings to provide physical protection to a radome are well known in the art and the coatings used herein are used in a standard conventional manner without substantial sacrificing the transmission characteristics of the construction. Although not specifically shown in FIG. 9 but exemplified below, when one or more such coatings are applied it will often be necessary to reduce the thickness of the outermost low dielectric constant layer 78 to tune the radome to a desired frequency or frequency range to compensate for the presence of the coating(s). Generally this will be done by (i) electrically tuning the basic D-sandwich, (ii) adding the outside protective layers as desired for a particular utility, and (iii) returning the structure by reducing the thickness of the outermost low dielectric constant layer. The protective coatings generally have thicknesses which are no more than about 50% of the thickness of the thinnest layer of the actual radome laminated structure. Thus, they are generally less than about 0.005 inch (0.127 mm) thick.

Figure 10:
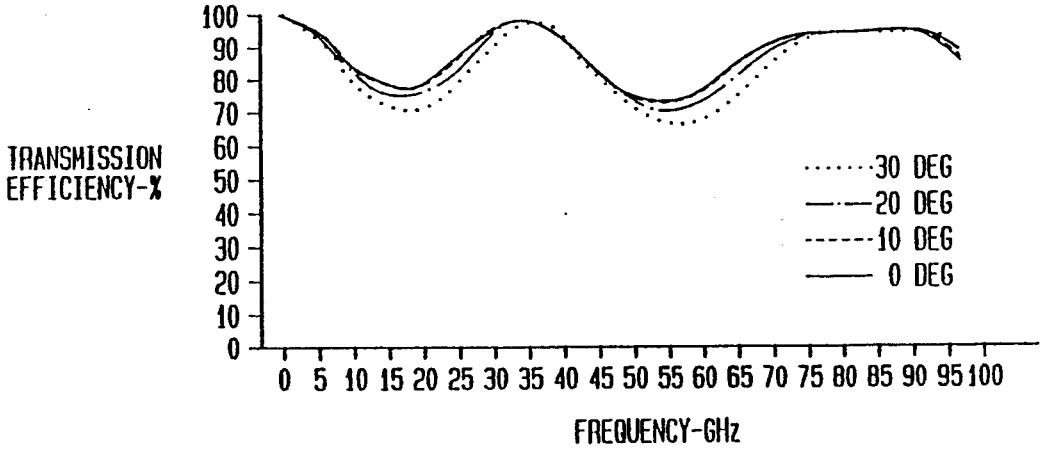
FIG. 10 shows a computer modeled plot of the transmission efficiency verses frequency for the embodiment of the invention as shown in FIG. 9 at various aspect angles.

As seen in FIG. 10, the transmission efficiency over the frequency spectrum has been computer modeled from 0 to 100 GHz for a multi-layer construction as shown in FIG. 9. The particular multi-layer construction forming this plot comprises a core layer 72 of low dielectric constant material having a thickness of about 0.03 inches with a dielectric constant of about 2.26 and a loss tangent of 0.0008. The high dielectric constant material layers 74 and 76 have a thickness of about 0.01 inches with a dielectric constant of 4.15 and a loss tangent of 0.015. The low dielectric constant material layer 80 is of similar construction to the core layer 72, but the outer low dielectric constant material layer 78 has been modified to account for the additional layers of this construction. The layer 78 is constructed to have a thickness of about 0.015 inch with a dielectric constant of 2.26 and a loss tangent of 0.0008. On the outer surface of layer 78, the protective coating 82 of polyester/fiberglass has a thickness of about 0.004 inches with a dielectric constant of 4.15 and a loss tangent of 0.015. The paint layer 84 has a thickness of about 0.003 inches with a dielectric constant of about 3.0 and a loss tangent of about 0.03.

It can be seen in FIG. 10, that the transmission efficiency of the multi-layer construction in accordance with FIG. 9 is maintained at acceptable values over the entire frequency range from 0 to 100 GHz, even at various aspect angles. Although the transmission efficiency has been degraded slightly due to the layer of epoxy/fiberglass 82 formed on the outer surface of the multi-layer construction, such degradation has not significantly effected the performance of the radome. It is again noted that transmission efficiency over relatively low frequencies of 0 to 20 GHz and very high frequencies of 80 to 100 GHz has been maintained well above the 70% level as well as providing excellent transmission characteristics at the frequency ranges of the atmospheric windows as mentioned previously. In some harsh environments in which the radome is to be used, the layer of polyester/fiberglass 82 formed on the outer surface of the multi-layer construction will provide the additional structural integrity desired while not limiting the effective use of the radome. Such a design for a radome may also be used on the nose of an aircraft, wherein the radome is relatively large and is intended to operate as a narrow band radome at 85 GHz over a wide angular range (0°–50°) of incident energy. When large radomes are desired, the structural stresses are such that the radome wall will need to be much thicker than described for FIG. 9. A radome construction of the invention can provide extremely broadband transmission characteristics or can be tuned for a narrower frequency bandwidth while providing better transmission at various incident angles as desired.

Figure 11:
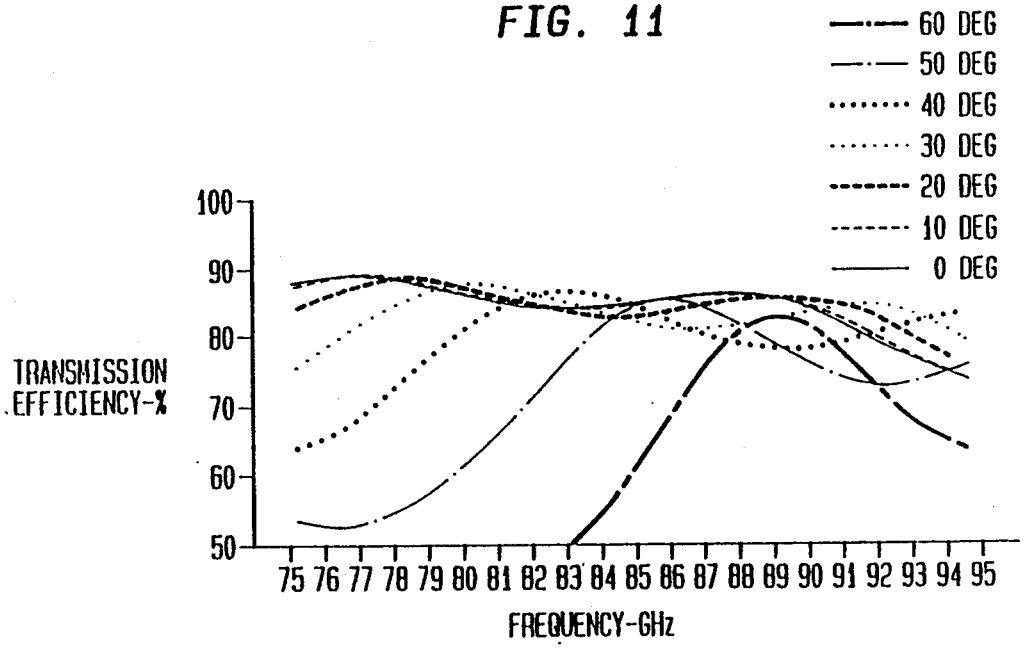
FIG. 11 shows a computer modeled plot of the transmission efficiency verses frequency for a radome construction in accordance with the invention over various aspect angles, which was designed to operate on an aircraft at 85 GHz.

Turning now to FIG. 11 there is shown a plot of the transmission efficiency relative to a frequency range of the multilayer radome construction designed to operate at 85 GHz in accordance with the invention over a variety of incident angles. Although incidence is shown from 0 to 60 degrees in the plot of FIG. 11, the actual areas of interest will normally fall between 0° and 20° for some applications and from 0° to 50° for others. The particular multi-layer construction used to form the plot of FIG. 11 comprised a core layer of low dielectric constant material having a thickness of about 0.084 inches. The core layer was bounded by layers of high dielectric constant material having a thickness of 0.04 inches which themselves were bounded by layers of low dielectric constant material having thicknesses of about 0.028 inches. It can be seen by the plots of 0°, 10° and even 20° incident angles that the transmission efficiency was maintained at a very high level over the frequency range. It can be seen from FIG. 11 that the multi-layer radome construction of the invention is not extremely susceptible to incident angle variations over a narrow frequency and thus provides additional advantages over some prior art multi-layer constructions. Because the multi-layer construction of the invention is not extremely susceptible to variations of incidence angle and provides excellent transmission efficiency over a broad bandwidth and high frequency range of 75 to 95 GHz, the radome is especially advantageous for a variety of applications not heretofore possible.

Figure 12:
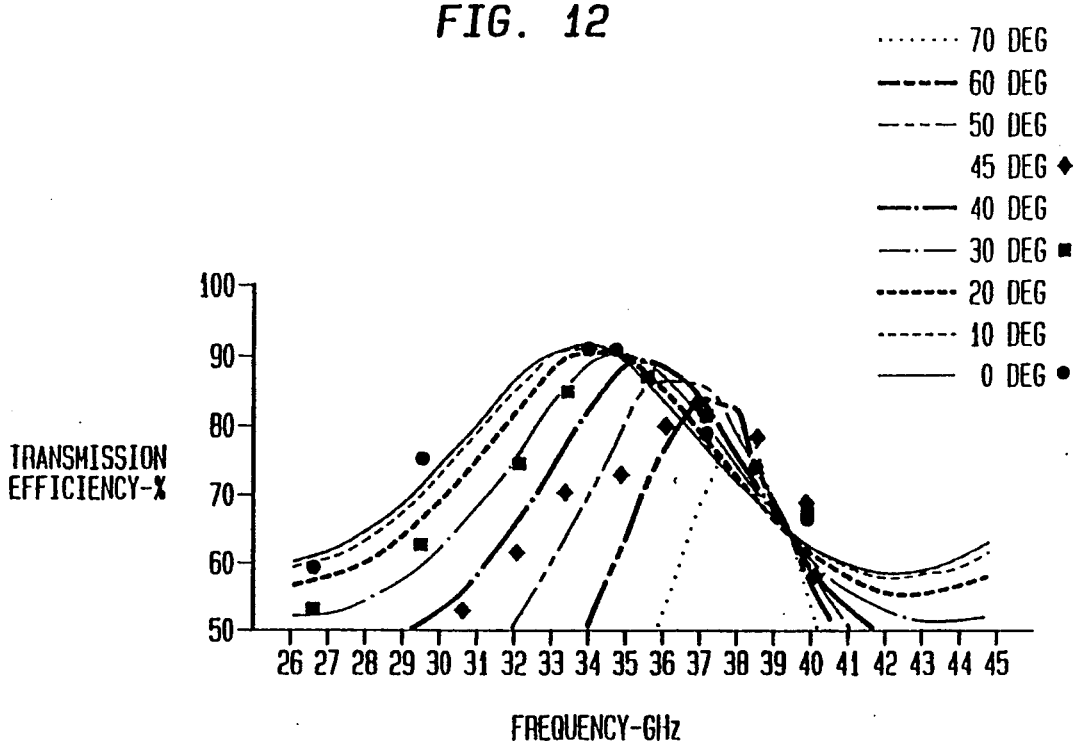
FIGS. 12 and 13 show computer modeled plots and actual test data of the transmission efficiency verses frequency for a full wave solid laminate radome and a radome according to the invention over various aspect angles, each of which was designed to operate on an aircraft at 35 GHz.
Figure 13:
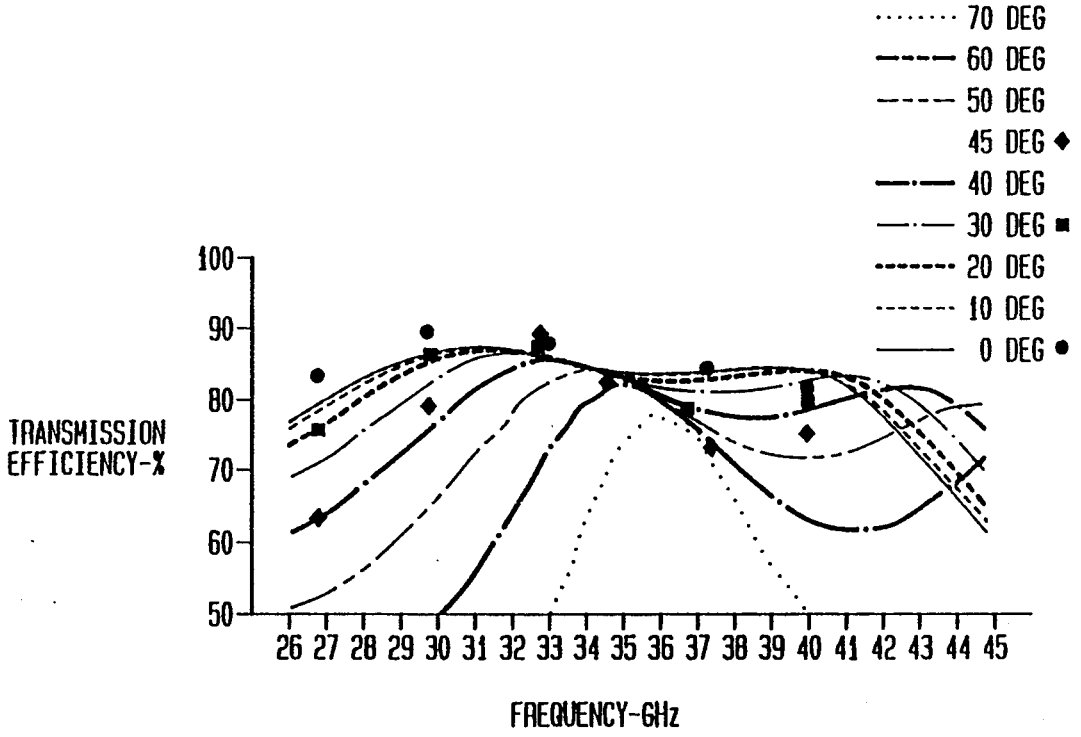

Turning now to FIGS. 12 and 13, there is shown an additional example of the radome construction of the invention as compared to a typical radome construction to provide desired transmission efficiency at a particular frequency range, and which will provide the proper structural integrity for use on a flight vehicle or the like. In this example, the radome construction was designed for a 35 GHz application for the front of an aircraft. As a great amount of structural rigidity is necessary for such an application, a typical radome construction may be designed as a full wave solid laminate radome functioning as a two half wave solid laminate construction. In FIG. 12, there is shown a plot of the transmission efficiency of a full wave solid laminate radome comprising an outer paint layer having a thickness of 0.005 inches and two half wave solid laminate constructions made with fiberglass cloth and a polyester resin system comprising a total thickness of 0.168 inch. The transmission efficiency of such a radome construction was computer modeled as shown by the plotted curves, along with actual test data being acquired for various incidence angles and being plotted by the discrete data points shown. It is seen in the plot of FIG. 12 that the full wave solid laminate did provide relatively good transmission efficiency at the 35 GHz frequency although only over a narrow frequency spectrum and narrow angular range.

The transmission efficiency of the full wave solid laminate as seen in FIG. 12 was then compared to a multi-layer radome construction in accordance with the invention, which also was tuned for the 35 GHz target frequency. The radome construction generating the plot of FIG. 13 comprises a core layer of low dielectric constant material having a thickness of 0.054 inches, which was bounded by high dielectric constant layers each having a thickness of 0.024 inches. The high dielectric constant layers are bounded by low dielectric constant material layers, wherein the inner layer has a thickness of 0.075 inches and the outer layer had a thickness of 0.054 inches. The outer layer of low dielectric constant material which would be subjected to the environmental conditions imposed on the radome was provided with a surface preparation of a very thin layer of polyester/fiberglass having a thickness of 0.004 inches and a layer of paint having a thickness of 0.005 inches similar to that shown in the embodiment of FIG. 9. The total thickness of this radome approach is about 0.228 inches plus the thickness of the paint which provides a configuration having the desired structural rigidity for flight vehicle applications. Again, the transmission efficiency of this radome construction was computer modeled over a broad frequency range about 35 GHz for various incidence angles. It should be evident upon a comparison of the plots of FIGS. 12 and 13 that the transmission efficiency of the multilayer construction of FIG. 13 is far superior to the full wave solid laminate structure as seen in FIG. 12. Actual test data is shown by the discrete plotted points in FIG. 13 for various incidence angles, where again it should be evident that transmission efficiency through the multi-layer construction was maintained at very high levels over a wide range of incidence angles and over the desired frequency range.

The multi-layer radome construction of the invention provides an extremely versatile and efficient radome construction which enables acceptable transmission over an extremely broad bandwidth. The radome construction enables effective transmission over a wider bandwidth and/or incidence angles without adversely affecting the antenna pattern than was possible with the prior radomes. The radome constructions yield increased transmission efficiencies over previous constructions, particularly at important frequencies above 20 GHz, especially above about 40 GHz, and particularly at frequencies of 35, 85 and 94 GHz.

Although the construction of the radome has been described relative to particular preferred embodiments, it is to be understood that various modifications to these embodiments will be readily apparent to those skilled in the art without departing from the spirit and scope of the invention as defined in the appended claims.

What is claimed is:

1. A radome having a multi-layer laminate construction comprising a core layer, two outermost layers, and two intermediate layers, each core, outermost, and intermediate layer providing substantial structural rigidity to the radome, and each intermediate layer being located between the core layer and one of the outermost layers, wherein the two intermediate layers have dielectric constants which are higher than the low dielectric constants of each of the core layer and the two outermost layers wherein the dielectric constant of each of the core and outermost layers is at least about 1.5, and wherein each of the low dielectric constant layers has a substantial electrical effect upon the performance of the radome.

2. The radome of claim 1 wherein the dielectric constant of each of the core and outermost layers is substantially equivalent.

3. The radome of claim 1 wherein the dielectric constants of each of the intermediate layers is substantially equivalent.

4. The radome of claim 1 wherein the dielectric constant of the core and outermost layers is about one-half of the dielectric constant of the intermediate layers.

5. The radome of claim 1 wherein the dielectric constant of the core and outermost layers is in the range from about 2 to less than about 3.5, and the dielectric constant of the intermediate layers is in the range from about 3.5 to 8.

6. The radome of claim 1 wherein the dielectric constant of the core and outermost layers is in the range from about 2 to 2.5, and the dielectric constant of the intermediate layers is in the range from about 4 to 5.

7. The radome of claim 1 further comprising a protective coating positioned on one of the outermost layers, wherein said coating comprises a material having a sufficiently high density to provide physical protection to the radome from precipitation and erosion while not substantially sacrificing transmission characteristics of the radome.

8. The radome of claim 7 wherein said protective coating has a thickness of about 0.001 to 0.005 inches.

9. The radome of claim 1 wherein the core and outermost layers are comprised of a fiber selected from the group consisting of oriented polyethylene fibers, polyaramide fibers, and polytetrafluoroethylene fibers, and the intermediate layers comprise a polyester/fiberglass composition.

10. The radome of claim 1 wherein each of said layers has a thickness which in combination with each of the other layers maximizes the transmission efficiency of the radome over a predetermined frequency range wherein each of said core and said outermost layers is of a thickness of from about 0.01 to 0.1 inch and each of said intermediate layers is of a thickness of from about 0.005 to 0.02 inch.

11. The radome of claim 10 wherein said predetermined frequency range is between DC and about 100 GHz.

12. The radome of claim 1 further containing an additional core layer located immediately between an intermediate layer and the outermost layer adjacent thereto and an additional intermediate layer located immediately between said additional core layer and said outermost layer.

13. A radome which efficiently permits electromagnetic energy over a broad frequency spectrum to be transmitted therethrough which comprises:

a core layer of dielectric material having a substantially uniform thickness with a first predetermined dielectric constant;

second and third layers of materials having dielectric constants and positioned around said core layer, said second and third layers being of predetermined substantially uniform thicknesses and having predetermined dielectric constants which are relatively higher than said first dielectric constant;

fourth and fifth layers of materials having dielectric constants, positioned on said second and third layers respectively, and having predetermined dielectric constants which are relatively less than the dielectric constants of said second and third layers;

said layers of dielectric constant material being formed into a unitary structure having a desired shape; and wherein the dielectric constant of each of the layers is greater than about 1.5.

14. The radome of claim 13 wherein the dielectric constant of each of the core, fourth and fifth layers are about 2 to less than about 3.5 and the dielectric constant of each of the second and third layers is about 3.5 to 8.

15. The radome of claim 13 further comprising a protective coating which improves the impact and erosion resistance of the radome, wherein said coating is positioned atop said fifth layer to form an outer radome surface which is subjected to the environment.

16. The radome of claim 15 further comprising a layer of paint atop the protective coating.

17. The radome of claim 13 wherein each of said core, fourth and fifth layers is of a thickness of from about 0.01 to 0.1 inch and each of said second and third layers is of a thickness of from about 0.005 to 0.02 inch.

18. A radome comprising a laminate construction of multiple layers of materials having dielectric constants, wherein the dielectric constants of the sequential layers of the radome from outermost to innermost is in an order selected from the group consisting of:

LOW-HIGH-LOW-HIGH-LOW

LOW-HIGH-LOW-HIGH-LOW-HIGH-LOW, and

LOW-HIGH-LOW-HIGH-LOW-HIGH-LOW-HIGH-LOW.

and wherein each of the LOW layers has a dielectric constant of at least about 1.5 and provides substantial structural rigidity to the radome.

19. The radome of claim 18 wherein the dielectric constant of each LOW layers is about 2 to less than about 3.5 and the dielectric constant of each of the HIGH layers is about 3.5 to 8.

20. The radome of claim 18 wherein the dielectric constants of each of the LOW layers is substantially equivalent.

21. The radome of claim 18 wherein the dielectric constants of each of the HIGH layers is substantially equivalent.

22. The radome of claim 18 wherein the dielectric constants of each of the LOW layers is about one-half of the dielectric constants of each of the HIGH layers.

23. The radome of claim 18 further comprising positioned on the outermost layer a protective coating of a material having a sufficiently high density to provide physical protection to the radome from erosion.

24. The radome of claim 23 further comprising a layer of ultraviolet light protecting paint positioned atop the protective coating.

25. A radome having an at least five layer laminate construction comprising a core layer and two outermost layers each providing substantial rigidity to the radome, and each layer being constructed of a material having a relatively low dielectric constant of at least about 1.5 and a thickness of from about 0.01 to 0.1 inch, each relatively low dielectric constant layer being separated from other relatively low dielectric constant layers by a layer of material having a higher dielectric constant than that of the relatively low dielectric constant materials, said higher dielectric constant layers each having a thickness of from about 0.005 to 0.02 inch.

26. The radome of claim 25 wherein the relatively low dielectric constant is from about 2 to less than about 3.5 and the relatively high dielectric constant is greater than about 3.5.

* * * * *

UNITED STATES PATENT AND TRADEMARK OFFICE

CERTIFICATE OF CORRECTION

PATENT NO. : 5,408,244

DATED : April 18, 1995

INVENTOR(S) : S. Benjamin Mackenzie

It is certified that error appears in the above-identified patent and that said Letters Patent is hereby corrected as shown below:

Claim 9, Column 12, line 66

Delete "polyaramide" and insert---
polyamide---

Cover Sheet, Item [73]

Delete "Wrocester, and insert---
Worcester---

Signed and Sealed this

Seventeenth Day of October, 1995

*Attest:*

Bruce Lehman

BRUCE LEHMAN

*Attesting Officer*

*Commissioner of Patents and Trademarks*